US006959466B2

(12) United States Patent
Alowonle et al.

(10) Patent No.: US 6,959,466 B2
(45) Date of Patent: Nov. 1, 2005

(54) POWER MANAGEMENT SYSTEM FOR STREET SWEEPER

(75) Inventors: Musibau O. Alowonle, Brooklyn Park, MN (US); Craig D. Block, St. Louis Park, MN (US); Robert J. Erko, Apple Valley, MN (US); Richard F. Milun, Corcoran, MN (US)

(73) Assignee: Tennant Company, Minneapolis, MN (US)

( * ) Notice: Subject to any disclaimer, the term of this patent is extended or adjusted under 35 U.S.C. 154(b) by 333 days.

(21) Appl. No.: 10/236,243

(22) Filed: Sep. 6, 2002

(65) Prior Publication Data

US 2004/0045117 A1 Mar. 11, 2004

(51) Int. Cl.[7] ..... E01H 1/05; E01H 1/08

(52) U.S. Cl. ..... 15/319; 15/340.3; 15/348; 15/349

(58) Field of Search ..... 15/319, 339, 340.1, 15/340.3, 347, 348, 349, 79.2, 83, 340.2, 15/340.4

(56) References Cited

U.S. PATENT DOCUMENTS

| | | | | |
|---|---|---|---|---|
| 3,879,789 A | * | 4/1975 | Kasper | 15/340.3 |
| 4,109,341 A | | 8/1978 | Larsen et al. | 15/340.1 |
| 4,138,756 A | * | 2/1979 | Krier et al. | 15/83 |
| 4,328,603 A | | 5/1982 | Dickson et al. | 15/84 |
| 4,343,060 A | | 8/1982 | Hildebrand et al. | 15/84 |
| 4,411,674 A | | 10/1983 | Forgac | 55/304 |
| 4,555,826 A | * | 12/1985 | Rodgers et al. | 15/340.3 |
| 4,615,070 A | | 10/1986 | Frederick et al. | 15/339 |
| 4,807,327 A | | 2/1989 | Jajko et al. | 15/346 |
| 5,013,333 A | | 5/1991 | Beaufoy et al. | 55/21 |
| 5,419,006 A | | 5/1995 | Duthie | 15/339 |
| 5,794,304 A | | 8/1998 | Ritter | 15/346 |
| 5,852,847 A | | 12/1998 | Weiss et al. | 15/346 |
| 6,023,813 A | * | 2/2000 | Thatcher et al. | 15/340.4 |
| 6,117,200 A | | 9/2000 | Berg et al. | 55/287 |
| 6,154,920 A | * | 12/2000 | Petrole et al. | 15/83 |
| 6,171,366 B1 | | 1/2001 | Vicard et al. | 95/1 |

* cited by examiner

*Primary Examiner*—Theresa T. Snider
(74) *Attorney, Agent, or Firm*—Fulbright & Jaworski L.L.P.

(57) ABSTRACT

A power management system for a surface maintenance machine, such as a street sweeper is disclosed. The system includes a variable speed engine for transporting the surface maintenance machine, a hydraulic pump powered by the engine, a vacuum fan motor powered by the hydraulic pump, an engine speed sensor coupled to the engine, an electric proportional valve coupled between the hydraulic pump and the vacuum fan motor, said valve for selectively restricting a flow rate to the vacuum fan motor, and a control unit operatively coupled to the engine speed sensor and the proportional valve, said control unit receiving engine speed information from the engine speed sensor and communicating a predetermined signal to the proportional valve to control the flow rate to the vacuum fan motor as a function of engine speed. A method of managing engine power from a single-engine street sweeper is also disclosed.

26 Claims, 2 Drawing Sheets

POWER MANAGEMENT SYSTEM FOR STREET SWEEPER

BACKGROUND OF THE INVENTION

1. Field of the Invention

This invention relates to a new and improved street sweeper and more particularly to a new and improved power management system for operating the various components of a street sweeper including such components as the vacuum fan, side brooms, the conveyor, and the like.

2. Description of the Prior Art

Single-engine street sweepers, such as disclosed in U.S. Pat. Nos. 4,343,060, and 4,328,603, each incorporated by reference herein, use the vehicle chassis engine to power the vehicle as well as the sweeping apparatus. Known sweepers typically use one or more hydraulic pumps driven by one or more power transmissions, such as a power-take-off (PTO) attached to the vehicle transmission.

Street sweepers operate at a variety of sweeping speeds, often up to 15 mph or more, and are required to negotiate slowly around obstacles, such as parked cars, while sweeping. Engine speed varies substantially as the travel speed varies during operation, such as from 1 to 15 mph. For example, at an idle the engine speed may be approximately 700 rpm, while at maximum travel speed (maximum throttle) the engine speed may be approximately 2000 RPM. The horsepower produced by the vehicle engine changes significantly within this range of engine speeds. For any given mechanical apparatus, functionality at low engine speeds may be limited as the horsepower may be insufficient to drive the associated pumps, actuators, etc.

Typically, street sweepers have onboard water spray systems to reduce dust clouding. These onboard spray systems are inefficient for having limited water capacity and requiring frequent refilling. Street sweepers typically do not have active dust suppression systems. During certain operations street sweepers may generate an objectionable airborne dust cloud. In residential areas the creation of a dust cloud may be especially objectionable. To minimize dusting, water may be applied to the surface prior to sweeping, such as via a water truck progressing ahead of the street sweeper. The additional step of applying water to the surface is economically and ecologically inefficient and undesirable. As a result, the sweeping operation may be limited during particularly dry or dusty periods. Assignee's U.S. patent applications Ser. No. 10/235,965, entitled "Retractable Broom and Dust Skirt", filed Sep. 4, 2002; Ser. No. 10/236,095, entitled "Street Sweeper", filed Sep. 6, 2002; Ser. No. 10/236,094, entitled "Street Sweeper", filed Sep. 6, 2002, each application being incorporated by reference herein, disclose aspects of a street sweeper having an active dust suppression system.

Certain air sweepers, such as disclosed in U.S. Pat. Nos. 4,109,341; 4,807,327; 5,794,304; and 5,852,847 have air pressure systems for moving a sufficient amount of air across the ground surface to capture debris for subsequent collection. The air pressure systems typically include a relatively large driven fan. It is recognized that significant fan horsepower is required to sweep large amounts of debris and control airborne dust. In some instances, a dedicated engine (separate from the vehicle engine) is used to power air pressure systems of an air sweeper.

Fixed displacement or variable displacement hydraulic pumps driving fixed displacement hydraulic motors to rotate main brooms, side brooms, and conveyors, have been commonly used on street sweepers for a number of years.

Hydraulic flow from a single pump is directed to two or more hydraulic motors for driving rotating sweeping components.

Variable displacement hydraulic pumps which are hydraulically pressure-flow compensated to provide a single constant output in gallonage within a given range of input speeds also have been known for a number of years.

Manually controlled variable displacement hydraulic pumps have been used to obtain a desired output in gallons per minute even though the input speed is constantly changing.

U.S. Pat. No. 4,343,060, incorporated by reference herein, discloses the use of a hydraulic system for a street sweeper which incorporates a variable volume hydraulic pump which is electronically controlled to provide a choice of three or more constant output speeds of the rotating sweeping components as the vehicle engine speed changes from between 1000–3000 RPM to provide optimum broom and conveyer speeds regardless of engine speed.

SUMMARY OF THE INVENTION

The present invention relates to a street sweeper having an improved hydraulic control system. The improved control system selectively operates the sweeping mechanisms such as brooms, conveyors, and the like within a plurality of operable ranges while an engine for powering the street sweeper operates at variable speeds. An important distinction of the present invention is the provision of a hydraulically-driven vacuum fan within a vacuum system to control dusting during sweeper operation. The improved hydraulic control system further selectively operates the vacuum fan within one of a plurality of selected operable ranges dependent on the engine speed.

One embodiment of the present invention involves using at least one "load-sensing" pressure and flow compensated piston pump for operating 3 or 4 fixed displacement hydraulic motors to rotate sweeping mechanisms (brooms and conveyor) at a constant speed, with a variable speed engine powering the hydraulic pump. Sensing means are used for electronically sensing the rotational speed of the engine. An engine speed signal is received by an electronic control unit which controls the operation of one or more electric proportional valves so as to control a flow rate to the hydraulic motors. A plurality of set points for the proportional valves may be programmed so that a discrete set of flow rates will correspond to different engine speeds. As a result, for a given engine speed the control unit in conjunction with a proportional valve operative defines a predetermined flow rate so that the speed of the sweeping mechanism remains constant within a given range of engine speed.

One advantage of this system is that one or more pumps may be utilized to operate the vacuum fan and sweeping mechanism as the engine speed (and pump speed) varies. As a result of providing the sweeper with the aforesaid feature, a cleaner sweeping operation can now be attained since the optimum vacuum fan speed and broom speed can be maintained at as low engine speeds as 800 RPM. This allows the operator to move the sweeping vehicle slowly through a conventional drive train system while maintaining the vacuum fan, brooms and conveyor at preferred more effective speeds.

At lower engine speeds, such as below 1000 RPM, there may not be adequate horsepower to operate the brushes, conveying system, and dry dust control vacuum fan at the required power levels for optimal performance. However, there is adequate power to operate at a reduced performance level that may be satisfactory for intermittent or infrequent time periods. An object of the present invention is to control the operation of the vacuum fan and sweeping mechanisms so that a reduced performance level is achieved during lower engine speeds.

BRIEF DESCRIPTION OF THE DRAWINGS

Other objects and features of this invention will more fully become apparent in view of the following detailed description taken in conjunction with the accompanying drawings, and in which a single embodiment is disclosed.

DESCRIPTION OF THE PREFERRED EMBODIMENTS

Figure 1:
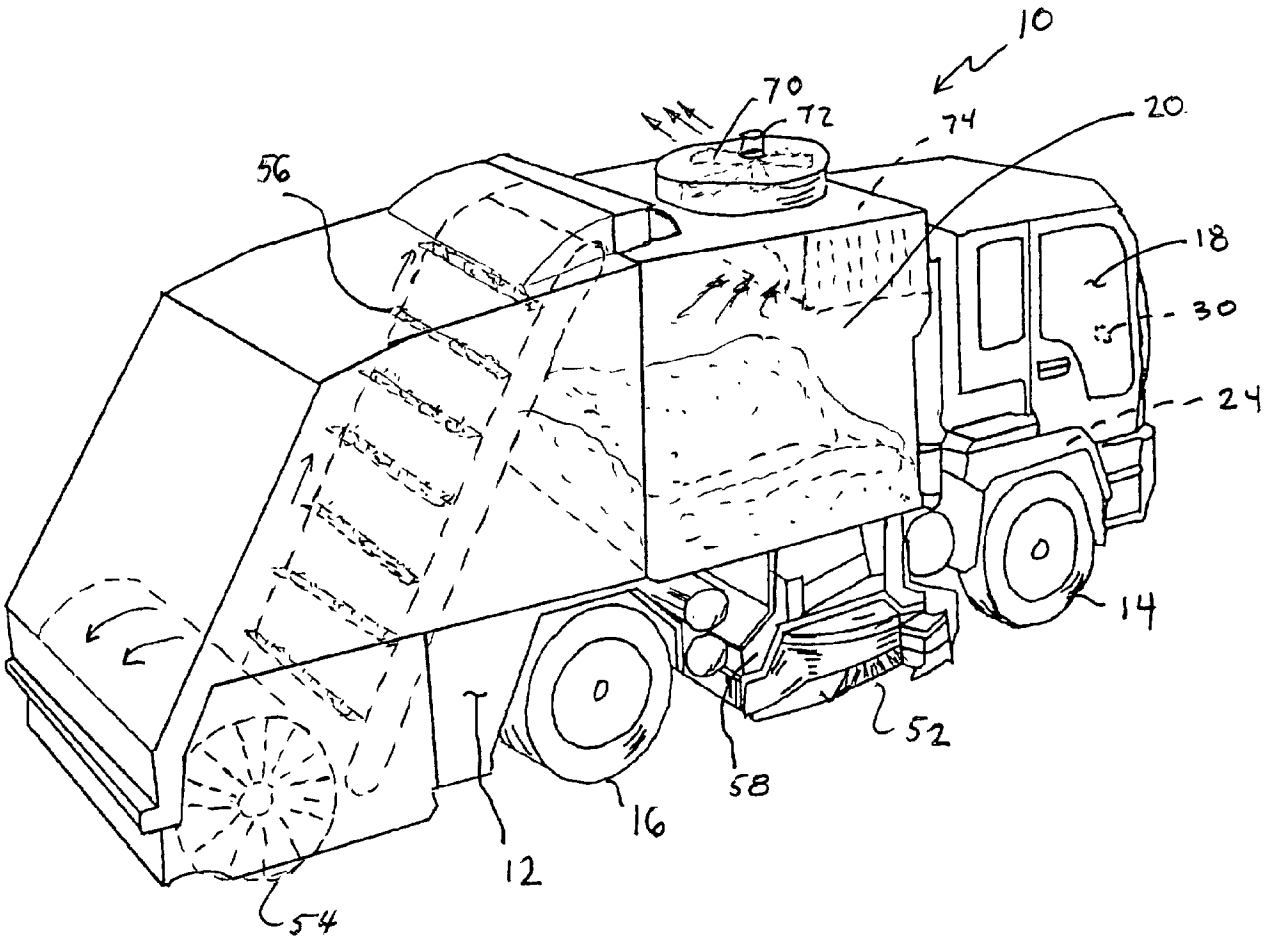
FIG. 1 is a perspective illustration of a street sweeper incorporating one embodiment of the present invention.

In FIG. 1 a self-propelled, four-wheeled street sweeper 10 is shown of the type that is particularly adapted to travel at relatively high speeds on open highways when traveling to and from areas to be swept and which is also capable of efficiently operating at slower speeds when sweeping streets.

The street sweeper 10 includes a main frame 12 that is supported by a front axle mounted on a pair of front wheels 14 and a rear axle mounted on a pair of rear wheels 16. An operator's cab 18 is disposed at the front end of sweeper 10 with a refuse collecting hopper 20 supported on the main frame 12 immediately behind cab 18. An engine 24 provides the drive to power wheels 16 for travel along a street surface at suitable speeds in accordance with traffic conditions. As described herein, engine 24 also provides power during the sweepers' mode of operation. As further described herein, a power management device including a control unit 30 and an engine speed sensor 40 are utilized to control a hydraulic system 50 of street sweeper 10.

Figure 2:
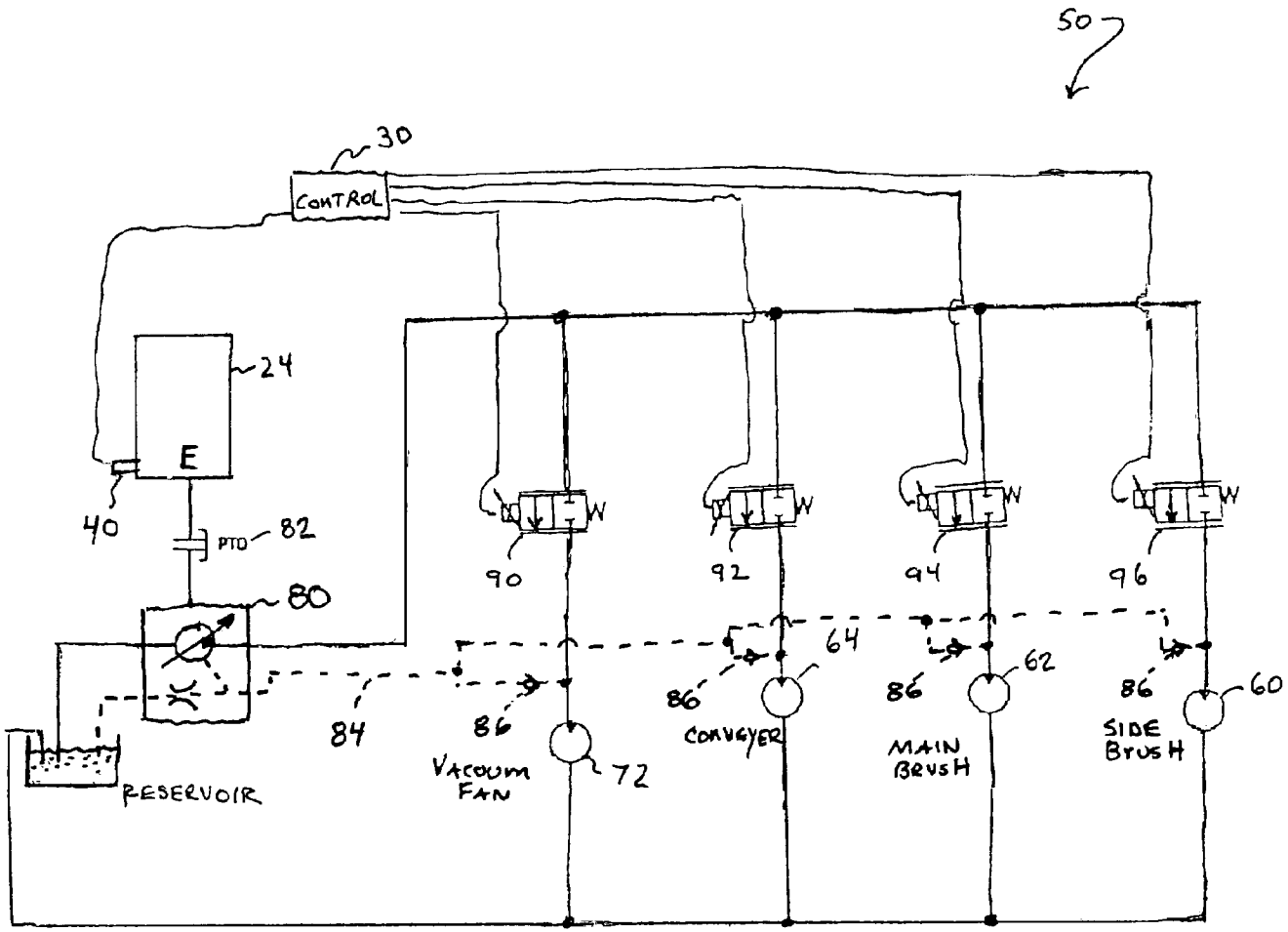
FIG. 2 is a diagram illustrating the electronic and hydraulic features of one embodiment of the present invention.

Street sweeper 10 includes a sweeping mechanism and a vacuum system. The sweeping mechanism includes one or more side brushes 52 which may extend to reach debris within a street gutter, a main pickup brush 54, and a debris conveyer 56. Side brush 52 may be housed within a brush housing 58. Additional aspects of the vacuum system are disclosed in patent application entitled "Retractable Broom and Dust Skirt", Ser. No. 10/235,965, filed Sep. 4, 2002, and incorporated by reference herein. Brushes 52, 54 and conveyer 56 are each powered by a hydraulic motor 60, 62, 64, respectively, as illustrated in FIG. 2. An elevating means (not shown) is provided for moving elements of the sweeping mechanism between transport and sweeping positions.

The vacuum system of street sweeper 10 includes a vacuum fan 70 powered by a hydraulic fan motor 72. Vacuum system functions to draw air from the main sweeping brush 54 and conveyer 56 through an air filter 74. A conduit (not shown) couples the vacuum system to side brush housing 58.

Referring to FIG. 2, the street sweeper engine 24 is arranged to power hydraulic system 50. FIG. 2 illustrates the basic elements of a hydraulic system 50 according to the present invention. Additional elements or features would be appreciated by one of ordinary skill in the art.

Engine 24 is coupled to a hydraulic pump 80, such as via a power-take-off (PTO) 82. Other devices to transfer engine 24 power to pump 80 would be appreciated by those of ordinary skill in the art. Such other devices may include for example, gears, power transmission, belts, etc. In a general sense, such other devices are considered to couple engine 24 to pump 80.

Pump 80 may include one or more discrete hydraulic pumps each being operatively coupled to engine 24 via suitable power transmission means. In one embodiment hydraulic pump 80 is a "load-sensing" pressure and flow compensated piston pump. Pressurized flow is produced by pump 80 to power several hydraulic motors 60, 62, 64, 72 associated with the sweeping operation. Pump 80 output may also power positioning devices or other hydraulic elements (not shown). Pump 80 is subject to considerable rotary speed fluctuations during routine sweeping operations in accordance with the driving speeds of the engine 24 in propelling the street sweeper 10 through traffic. Hydraulic system 50 includes vacuum fan motor 72, main brush motor 62, conveyer motor 64, and side brush motor 60. Associated with each motor 60, 62, 64, 72 is a proportional valve 90, 92, 94, 96. Proportional valves 90, 92, 94, 96 are responsive to an electric signal to vary a fluid flow therethrough. In other words, proportional valves 90, 92, 94, 96 function as selectively adjustable flow restrictors. As described further herein with reference to operation of control unit 30, each proportional valve 90, 92, 94, 96 may receive a signal from control unit 30. The signals may be pulse-width-modulated signals implemented with necessary controls and features as appreciated by one skilled in the art.

Pump 80 is preferably a variable flow pump being either pressure compensated or pressure and flow compensated. Pump 80 may comprise one or more such pumps. In the illustrated preferred embodiment of FIG. 2, pump 80 is a "load-sensing" pressure and flow compensated pump having a pressure communicating "sense" line 84 returning to pump 80. Sense line 84 is coupled between associated valves 90, 92, 94, 96 and motors 60, 62, 64, 72. A number of check valves 86 are provided to limit the direction of fluid flow within line 84.

A control system of the present invention may be utilized as a power management system. Control unit 30 receives engine speed information from speed sensor 40 and makes compensating adjustments to one or more of the proportional valves 90, 92, 94, 96 as engine speed changes. When the engine speed begins to slow down, proportional valves 90, 92, 94, 96 are adjusted to restrict fluid flow in conduits feeding motors 60, 62, 64, 72 conversely, when the engine speed increases, proportional valves 90, 92, 94, 96 are adjusted to permit a greater flow rate through conduits feeding motors 60, 62, 64, 72. Pump 80 responds to these changes in flow requirements by producing only the amount of fluid flow required by the valves 90, 92, 94, 96. As a result, horsepower required to drive pump 80 changes in relation to the required flow to motors 60, 62, 64, 72.

In one embodiment of the present invention, control unit 30 may select a proportional valve signal from among a group of signals including an idle speed signal, a low speed signal, and a full speed signal. For example, for an idle speed range of approximately 800–900 RPM, an idle speed signal may be sent to proportional valve 90 associated with vacuum fan motor 72 to restrict fluid flow to vacuum fan motor 72. As a result in this example, with the idle speed signal being presented to the vacuum fan proportional valve 90, the fan 70 speed may be approximately 500 RPM. To further this example, as the engine speed increases to within a range of approximately 900–1150 RPM, a low speed signal may be presented by control unit 30 to proportional valve 90 so that additional fluid flow is received by vacuum fan motor 72. As a result, with the low speed signal being presented to the vacuum fan proportional valve 90, the fan 70 speed may be approximately 1000 RPM. To yet further this example, as the engine speed increases to within a range of approximately 1150–2300 RPM, a full speed signal may be sent to proportional valve 90, the fan 70 speed increasing to approximately 2000 RPM (with clean filter). Other ranges of engine speeds may be utilized to practice additional embodiment of the present invention. In another embodiment of the present invention two ranges of engine speeds, such as idle and full speed, may have corresponding idle and full speed signals being communicated by control unit 30 to proportional valve 90.

Additional advantages and modifications will readily occur to those skilled in the art upon reflection on the teaching, written disclosure and illustrations herein. The invention in its broader aspects is, therefore, not limited to the specific details, representative apparatus and illustrative examples shown and described. Accordingly, departures from such details may be made without departing from the spirit or scope of the applicant's general inventive concept.

We claim:

1. A street sweeper comprising:

a variable speed engine;

an engine speed sensor coupled to the engine for providing engine speed information to a control unit;

a hydraulic pump operatively coupled to the engine;

a sweeping mechanism powered by the hydraulic pump and including a main pickup brush and a debris conveyer;

a vacuum system including a vacuum fan motor powered by the hydraulic pump, said vacuum system for creating an airflow within the street sweeper;

an electric proportional valve coupled between the hydraulic pump and the vacuum fan motor, said valve for selectively restricting a flow rate of hydraulic fluid to the vacuum fan motor; and the control unit operatively coupled to the engine speed sensor and the proportional valve, said control unit receiving the engine speed information from the engine speed sensor and communicating a control signal to the proportional valve to control the flow rate of hydraulic fluid to the vacuum fan motor as a function of engine speed.

2. The street sweeper of claim 1, further comprising a hydraulic conveyer motor and a hydraulic side brush motor, each of said motor being in fluid communication with the hydraulic pump.

3. The street sweeper of claim 2, further comprising a set of electric proportional valves coupled between the hydraulic pump and the hydraulic conveyer motor and the hydraulic side brush motor, each one of said set of electric proportional valves being responsive to a signal sent from the control unit to control a flow rate of hydraulic fluid.

4. The street sweeper of claim 1 wherein the control signal is a pulse-width-modulated signal.

5. The street sweeper of claim 1 wherein the control signal is selected from among a group of signals including an idle speed signal, a low speed signal, and a full speed signal.

6. The street sweeper of claim 1 wherein the hydraulic pump includes at least two hydraulic pumps each operatively coupled to the engine.

7. The street sweeper of claim 1 further comprising an air filter in communication with the vacuum system, said air filter separating debris from the airflow.

8. A power management system for a street sweeper comprising:

a variable speed engine for transporting the street sweeper and for powering sweeping components of the street sweeper, said engine being operable within either an idle speed range and a full speed range;

an engine speed sensor coupled to the engine for providing engine speed information to a control unit;

a hydraulic pump powered by the engine;

a vacuum fan motor powered by the hydraulic pump;

an electric proportional valve coupled between the hydraulic pump and the vacuum fan motor, said valve for selectively restricting a flow rate of hydraulic fluid to the vacuum fan motor; and the control unit operatively coupled to the engine speed sensor and the proportional valve, said control unit receiving the engine speed information from the engine speed sensor and communicating a control signal to the proportional valve to control the flow rate of hydraulic fluid to the vacuum fan motor as a function of engine speed.

9. The power management system of claim 8, further comprising a hydraulic conveyer motor and a hydraulic side brush motor, said motors being in fluid communication with the hydraulic pump.

10. The power management system of claim 9, further comprising a set of electric proportional valves coupled between the hydraulic pump and the hydraulic conveyer motor and the hydraulic side brush motor, each one of said set of electric proportional valves being responsive to a signal sent from the control unit to control a flow rate of hydraulic fluid.

11. The power management system of claim 8 wherein the control signal is a pulse-width-modulated signal.

12. The power management system of claim 8 wherein the control signal is selected from among a group of signals including an idle speed signal and a full speed signal.

13. The power management system of claim 8 wherein the hydraulic pump includes at least two hydraulic pumps each operatively coupled to the engine.

14. The power management system of claim 8 further comprising an air filter in communication with an airflow generated by the vacuum fan motor.

15. A street sweeper comprising:

an engine for transporting a vehicle and for powering a sweeping mechanism and a vacuum system;

an engine speed sensor coupled to the engine for providing engine speed information to a control unit;

a hydraulic pump operatively coupled to the engine;

a hydraulic vacuum fan motor powered by the hydraulic pump;

a main cylindrical pickup broom coupled to the vehicle;

a debris conveyer for transporting debris from the pickup broom to a debris collection hopper;

a gutter broom operatively coupled to the vehicle;

an electric proportional valve coupled between the hydraulic pump and the vacuum fan motor, said valve for selectively restricting a flow rate of hydraulic fluid to the vacuum fan motor; and the control unit operatively coupled to the engine speed sensor and the proportional valve, said control unit receiving the engine speed information from the engine speed sensor and communicating a control signal to the proportional valve to control the flow rate of hydraulic fluid to the vacuum fan motor as a function of engine speed.

16. The street sweeper of claim 15, further comprising a hydraulic conveyer motor and a hydraulic side brush motor, said motors being in fluid communication with the hydraulic pump.

17. The street sweeper of claim 16, further comprising a set of electric proportional valves coupled between the hydraulic pump and the hydraulic conveyer motor and the hydraulic side brush motor, each one of said set of electric proportional valves being responsive to a signal sent from the control unit to control a flow rate of hydraulic fluid.

18. The street sweeper of claim 15 wherein the control signal is a pulse-width-modulated signal.

19. The street sweeper of claim 15 wherein the control signal is selected from among a group of signals including an idle speed signal, a low speed signal, and a full speed signal.

20. A method of managing engine power for a street sweeper, said street sweeper including a variable speed engine, a sweeping mechanism powered by the engine and including a main pickup brush, a vacuum system including a hydraulic vacuum fan motor, an engine speed sensor coupled to the engine for providing engine speed information to a control unit, a hydraulic pump coupled to the engine, an electric proportional valve coupled between the hydraulic pump and the vacuum fan motor, said valve for selectively restricting a flow rate of hydraulic fluid to the vacuum fan motor, and the control unit operatively coupled to the engine speed sensor and the proportional valve, said control unit receiving the engine speed information from the engine speed sensor and communicating a control signal to the proportional valve to control the flow rate of hydraulic fluid to the vacuum fan motor as a function of engine speed, said method comprising the steps of:

(a) operating the engine at a first selected engine speed;

(b) communicating engine speed information from the engine speed sensor to the control unit;

(c) selecting a proportional valve setting from among a group of valve settings;

(d) communicating a control signal from the control unit to the proportional valve, said control signal associated with the proportional valve setting selected in step (c);

(e) adjusting the proportional valve in response to the signal communicated in step (d) in order to adjust a flow of hydraulic fluid to the vacuum fan motor; and (f) repeating steps (a) through (e) with the engine operating at a second engine speed in order to manage engine power.

21. The method of managing engine power of claim 20 from a single-engine street sweeper wherein the group of valve settings includes at least an idle speed setting and a full speed setting.

22. The method of managing engine power of claim 20 from a single-engine street sweeper wherein the control signal communicated from the control unit to the proportional valve is a pulse-width-modulated signal.

23. A power management system for a surface maintenance machine, said system comprising:

a variable speed engine for transporting the surface maintenance machine, said engine operating within one of an idle speed range, an intermediate speed range, and a full speed range;

a hydraulic pump powered by the engine;

a vacuum system including a hydraulic vacuum fan motor powered by the hydraulic pump;

an engine speed sensor coupled to the engine for providing engine speed information to a control unit;

an electric proportional valve coupled between the hydraulic pump and the vacuum fan motor, said valve for selectively restricting a flow rate of hydraulic fluid to the vacuum fan motor; and the control unit operatively coupled to the engine speed sensor and the proportional valve, said control unit receiving the engine speed information from the engine speed sensor and communicating a control signal to the proportional valve to control the flow rate of hydraulic fluid to the vacuum fan motor as a function of engine speed.

24. The power management system of claim 23 wherein the control signal is selected from among a group of signals including at least an idle speed signal and a full speed signal.

25. The power management system of claim 24 wherein the group of signals includes an intermediate speed signal.

26. The power management system of claim 24 wherein the hydraulic pump includes at least two hydraulic pumps each operatively coupled to the engine.

* * * * *